US006105747A

United States Patent [19]

Uemizo et al.

[11] Patent Number: 6,105,747

[45] Date of Patent: Aug. 22, 2000

[54] BILL VALIDATOR WITH A SHUTTER UNIT

[75] Inventors: Yoshiaki Uemizo; Kensuke Matsunaga; Kazuhiro Hamaguchi, all of Osaka, Japan

[73] Assignee: Japan Cash Machine Co., Ltd., Japan

[21] Appl. No.: 09/107,347

[22] Filed: Jun. 30, 1998

[51] Int. Cl.[7] ..... G07F 7/04

[52] U.S. Cl. ..... 194/203; 194/206; 194/351

[58] Field of Search ..... 194/203, 206, 194/207, 351

[56] References Cited

U.S. PATENT DOCUMENTS 5,709,293 1/1998 Ishida et al. ..... 194/207 X

*Primary Examiner*—F. J. Bartuska

*Attorney, Agent, or Firm*—Bachman & LaPointe, P.C.

[57] ABSTRACT

A shutter unit 17 of a bill validator comprises a blocking member 18 movable between an interceptive position for closing the through hole 74 of the shutter unit 17 and a release position away from the through hole 74 for allowing passage of the bill through the through hole 74 into a slot 13 of the validating unit 20; a control unit 48 movable between an inactive position for barring movement of the blocking member 18 to the release position and an operative position for allowing movement of the blocking member 18 to the release position; and an actuator 50 for shifting the control unit 48 between the inactive and operative positions. When the blocking member 18 is forcibly moved to the release position in an unauthorized manner, the control unit 48 in the inactive position effectively inhibits and resists movement of the blocking member 18 to the release position.

20 Claims, 7 Drawing Sheets

BILL VALIDATOR WITH A SHUTTER UNIT

FIELD OF THE INVENTION

This invention relates to a bill validator capable of preventing unauthorized extraction of a bill from inside to outside of the bill validator by pulling out a string or tape connected with the bill.

PRIOR ART

For example, Japanese Patent Disclosure No. 7-175957 discloses a bill validator provided with a shutter device to prevent unauthorized extraction of a bill transported into the bill validator to outside thereof. The shutter device is provided with a blocking member disposed adjacent to pulleys and belts of a conveyor for transporting the bill along a passageway in the bill validator. The blocking member is movable between an interceptive position for inhibiting passage of the bill through a passageway formed in the bill validator and a release position away from the passageway for allowing passage of the bill through the passageway. In addition, the blocking member is urged toward the interceptive position by its gravity and resilient force of a spring, and is moved from the interceptive to the release position by a solenoid against the gravity of the blocking member and resilient force of the spring when a bill is inserted into an inlet of the bill validator. Therefore, the shutter device is defective in that the blocking member can forcibly be moved from the interceptive to the release position in an unauthorized manner by a tool inserted into the inlet against the gravity of the blocking member and resilient force of the spring. In addition, in case of some trouble or breakdown of the prior art shutter device, the bill validator must thoroughly be disassembled from the pulleys and belts of the conveyor with time-consuming and troublesome dismantling operation for repair or maintenance.

Therefore, an object of the present invention is to provide a bill validator sufficiently resistible against the unauthorized movement of the blocking member to the release position.

Another object of the present invention is to provide a bill validator having a shutter unit wherein a blocking member is movable between the interceptive and release positions, but firmly retained in the interceptive position after once moved to the interceptive position.

Still another object of the present invention is to provide a bill validator with a shutter unit detachably attached thereto.

A further object of the invention is to provide a bill validator capable of inhibiting entry of cold air into the bill validator.

SUMMARY OF THE INVENTION

A bill validator of this invention includes a validating unit (20) and a shutter unit (17) attached to a front side of the validating unit (20). The shutter unit (17) includes a through hole (74) formed with an inlet (72) at one end of the through hole (74) to insert a bill into the inlet (72), and an outlet (75) at the other end of the through hole (74). The shutter unit (17) comprises a blocking member (18) movable between an interceptive position for closing the through hole (74) of the shutter unit (17) and a release position away from the through hole (74) for allowing passage of the bill through the through hole (74) into a slot (13) of the validating unit (20); a control unit (48) movable between an inactive position for barring movement of the blocking member (18) to the release position and an operative position for allowing movement of the blocking member (18) to the release position; and an actuator (50) for shifting the control unit (48) between the inactive and operative positions. When the blocking member (18) is forcibly moved to the release position in an unauthorized manner, the control unit (48) in the inactive position effectively inhibits and resists movement of the blocking member (18) to the release position, thereby preventing unauthorized extraction of the bill from inside of the bill validator by pulling out string or tape connected with the bill.

In an embodiment of the present invention, the control unit (48) comprises a clasp (52) rotatably mounted on a shutter frame (70) around a shaft (61) between the inactive and operative positions upon operation of the actuator (50) to prevent and allow movement of the blocking member (18) to the release position. In another embodiment of the invention, the control unit (48) may include a clasp (52) slidable along a guide recess (69) between the inactive and operative positions by the actuator (50). Otherwise, the control unit (48) may include a link (51) drivingly connected with the actuator (50); a clasp (52) movably mounted on a shutter frame (70) between the inactive position for barring movement of the blocking member (18) to the release position and the operative position for allowing movement of the blocking member (18) to the release position. The clasp (52) is rotatable around a shaft (61) between the inactive and operative positions upon operation of the actuator (50) to prevent and allow movement of the blocking member (18) to the release position when the clasp (52) is moved respectively to the inactive position and the operative position. The clasp (52) is drivingly connected with the link (51) which is also operatively connected with the blocking member (18) with a gap **(57*a*) to rotate the clasp (52) from the inactive to the operative position by the link (51) before the blocking member (18) starts moving from the interceptive to the release position. A protrusion (56) is provided in one of the blocking member (18) and link (51), and a notch (57) is formed in the other of the blocking member (18) and link (51) to receive the protrusion (56) with a gap (57*a*). For example, the protrusion (56) provided in the blocking member (18) is positioned in the notch (57) formed in the link (51) with the gap (57*a*)**.

The validating unit (20) comprises a case (11), a passageway (12) formed in the case (11) and having a slot (13) and an outlet (14) at the opposite ends thereof, a conveying device (15) for transporting the bill from the slot (13) through the passageway (12) to the outlet (14); and a bill sensor (16) disposed adjacent to the passageway (12) for detecting an optical or magnetic feature of the bill. The link (51) is rotatably mounted by a shaft (53) on a shutter frame (70) and drivingly connected with the actuator (50) which comprises a solenoid with a plunger **(50*b*) connected with the link (51)**.

The control unit (48) is formed with a blocking edge **(52*a*) in contact with the blocking member (18) to bar movement of the blocking member (18) toward the release position when the control unit (48) is in the inactive position. The clasp (52) is formed with a blocking edge (52*a*) which can be vertically aligned with the shaft (61) and an abutment (56*c*) of the blocking member (18) so that the blocking edge (52*a*) is in contact with the abutment (56*c*) at a dead point to prevent movement of the clasp (52) from the inactive to operative position, and thereby to bar movement of the blocking member (18) toward the release position. The actuator (50) comprises a solenoid (50*a*) with a movable plunger (50*b*) connected with the control unit (48) to move the control unit (48) between the inactive and operative positions. The shaft (61) produces a resisting force against the vertical movement of the blocking member (18) when the abutment (56***c*) of the blocking member (18) is forcibly urged toward the blocking edge (52*a*) of the clasp (52) at the dead point. The shutter unit (17) comprises a shutter frame (70) for covering the link (51) and clasp (52); and a bolt (71) for removably attaching the shutter frame (70) to the case (11) of the validating unit (20). Mounted in the vicinity of the inlet (72) of the shutter unit (17) is an inlet sensor (73) which produces a detection signal when a bill is inserted into the inlet (72). A slot sensor (40) mounted in the vicinity of the slot (13) produces a detection signal when the bill is inserted into the slot (13). The actuator (50), inlet sensor (73) and slot sensor (40) are electrically connected with a validating control circuit (80) which activates the actuator (50) when received the detection signal from the inlet sensor (73) to move the blocking member (18) to the release position, and when received the detection signal from the slot sensor (40), the validating control circuit (80) deactivates the actuator (50) to return the blocking member (18) to the interceptive position. The blocking member (18) is resiliently urged by a spring (92) toward the interceptive position, and drivingly connected with the clasp (52) with a gap (57*a*). A small gap (52*b*) is formed between the abutment (56*c*) and clasp (52) to rotate the clasp (52) while the blocking member (18) is retained in the static condition.

The above-mentioned as well as other objects of the present invention will become apparent during the course of the following detailed description and appended claims.

BRIEF DESCRIPTION OF THE DRAWINGS

Preferred embodiments of the present invention will be described with reference to the accompanying drawings in which.

DETAL DESCRIPTION OF THE INVENTION

Figure 1:
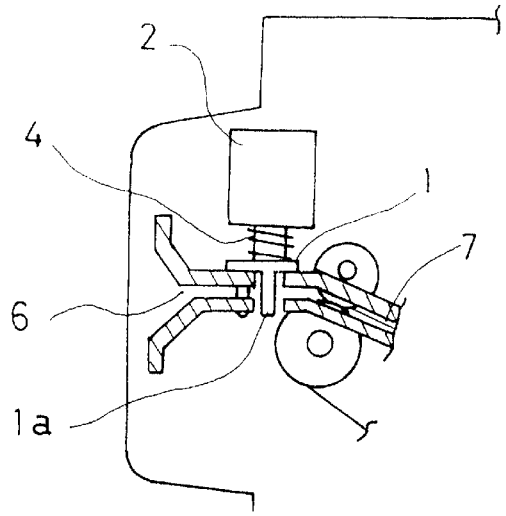
FIG. 1 PRIOR ART
FIG. 1 is a partial cross-sectional view of a prior bill validator.
Figure 2:
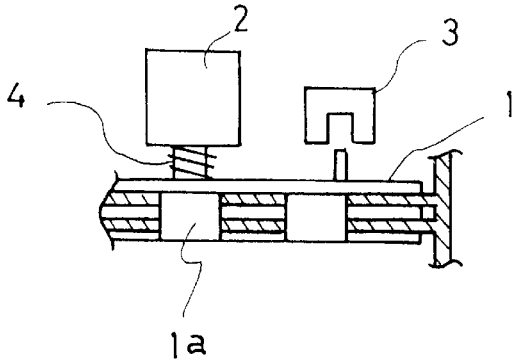
FIG. 2 PRIOR ART
FIG. 2 is a front view of FIG. 1.
Figure 3:
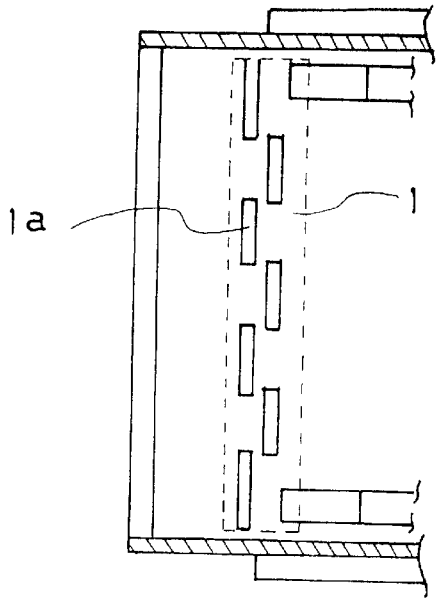
FIG. 3 PRIOR ART
FIG. 3 is a plan view of FIG. 1.

As shown in FIGS. 1 to 3, a prior art bill validator includes a passageway 7 which has an inlet 6 formed at an outer end of the passageway 7 to insert a bill therein. Mounted on the passageway 7 is a blocking member 1 movable between an interceptive position in the passageway 7 for preventing passage of the bill through the passageway 7 and a release position away from the passageway 7 for allowing passage of the bill through the passageway 7. A spring 4 is provided to resiliently urge the blocking member 1 toward the interceptive position. A solenoid 2 is designed to shift the blocking member 1 from the interceptive to the release position against resilient force of the spring 4. A photoelectric sensor 3 is provided to detect the blocking member 1 in the release position.

Not shown but, the bill validator also is provided with an inlet sensor for detecting insertion of the bill into the inlet 6 to activate the solenoid 2. The blocking member 1 includes a plurality of nail portions la positioned along two lateral rows in a staggered arrangement so that these nail portions 1*a* are put in and interrupt the passageway 7 when the blocking member 1 is in the interceptive position.

The inlet sensor detects a bill inserted into the inlet 6 to produce a detection signal which is utilized to activate the solenoid 2 so that the blocking member 1 is upwardly moved from the interceptive to the release position. When the bill is transported along the passageway 7 by a conveyor not shown to a predetermined inner position, the solenoid 2 is deactivated, and therefore, the blocking member 1 is urged toward the interceptive position by resilient force of the spring 4. At the moment, the nail portions 1*a* contact the bill and the blocking member 1 cannot return to the interceptive position because the bill is on the way of the passageway 7 beneath the nail portions 1*a*, and the whole of the bill has not yet fully passed over the blocking member 1. Consequently, the photoelectric sensor 3 detects the blocking member 1 absent in the interceptive position and the bill is further successively moved inwardly by the conveyor. When a rear end of the bill has completely passed over the blocking member 1, the nail portions 1*a* is free from engagement with the bill to allow the blocking member 1 to go to the interceptive position by elastic force of the spring 4. When the blocking member 1 returns to the interceptive position, the photoelectric sensor 3 produces a detection signal to the validator. However, if a tape or string is connected with the bill, it is positioned in the passageway 7 and contacts the blocking member 1 which is therefore prevented from returning to the interceptive position, and the photoelectric sensor 3 cannot produce the detection signal. In this case, the validator decides that the bill is too long and therefore invalid due to existence of the attached tape or string, and the validator drives the conveyor in the reverse direction to return it to the inlet 6.

However, such a prior art shutter device is defective in that the blocking member 1 can forcibly be moved from the interceptive to the release position by a tool because the blocking member 1 is simply urged by only its gravity and resilient force of the spring 4. Specifically, the blocking member 1 can easily be moved from the interceptive to the release position in an unauthorized manner by the tool inserted into the inlet 6 against the gravity of the blocking member 1 and the resilient force of the spring 4. Thus, such prior art shutter device is disadvantageous because it is not resistible against the unauthorized movement of the blocking member 1 to the release position. In addition, when there is some trouble or breakdown of the prior art shutter device, the bill validator must thoroughly be disassembled from the pulleys and belts of the conveyor for repair or maintenance, and the disassembling operation is time-consuming and troublesome.

Figure 4:
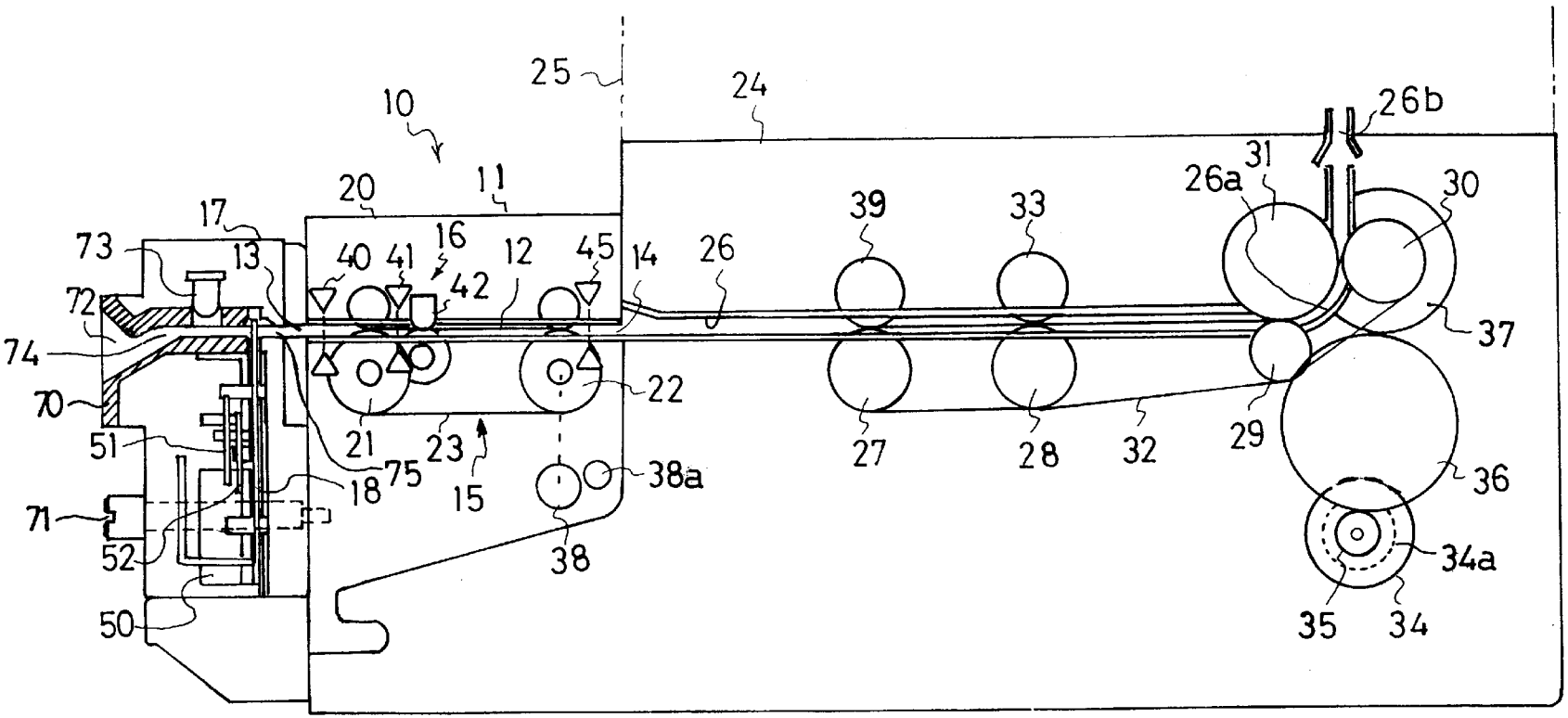
FIG. 4 is a cross-sectional view showing an embodiment of a bill validator according to this invention.
Figure 5:
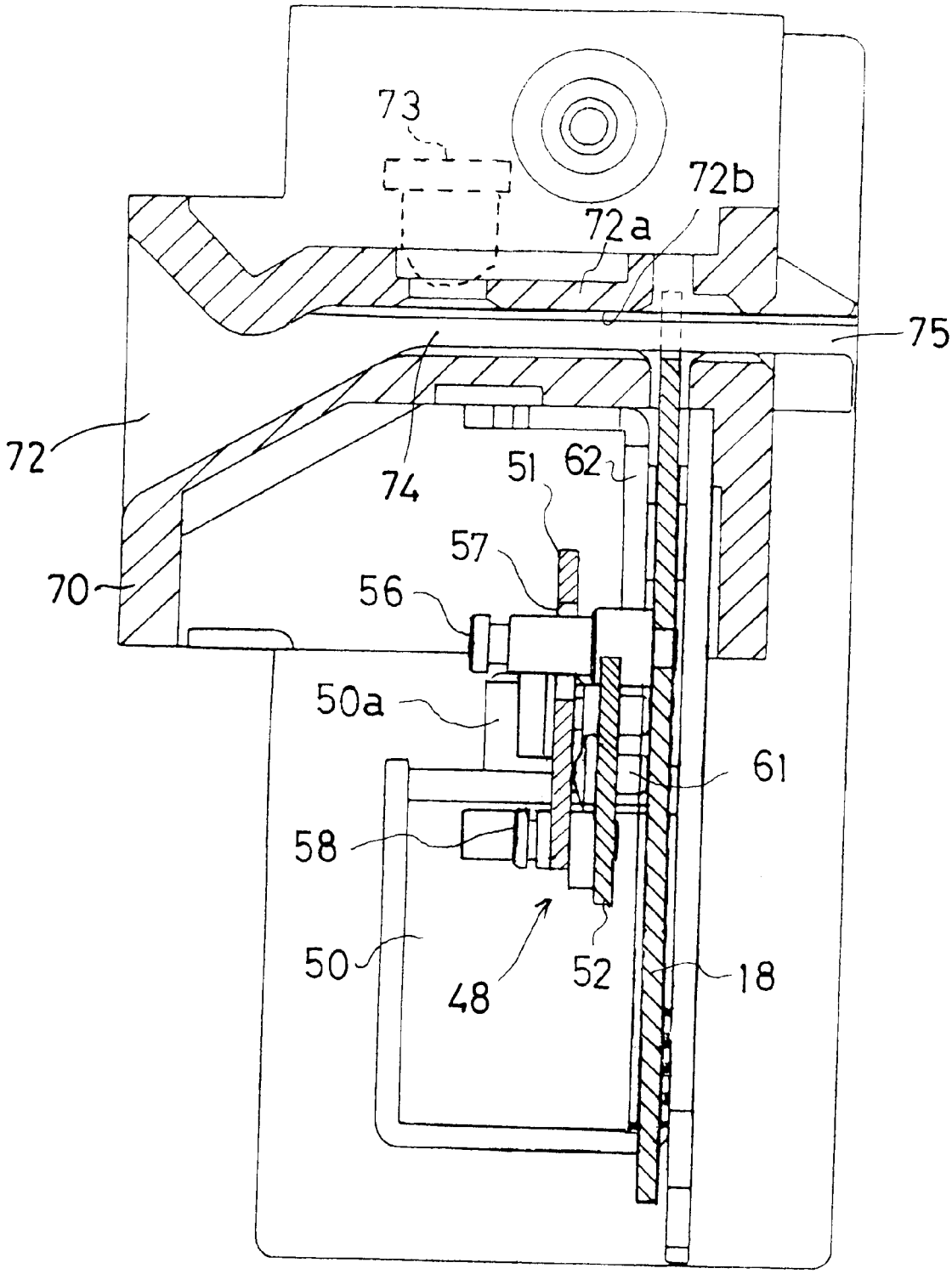
FIG. 5 is a cross-sectional view of a shutter unit used in a bill validator according to this invention.
Figure 6:
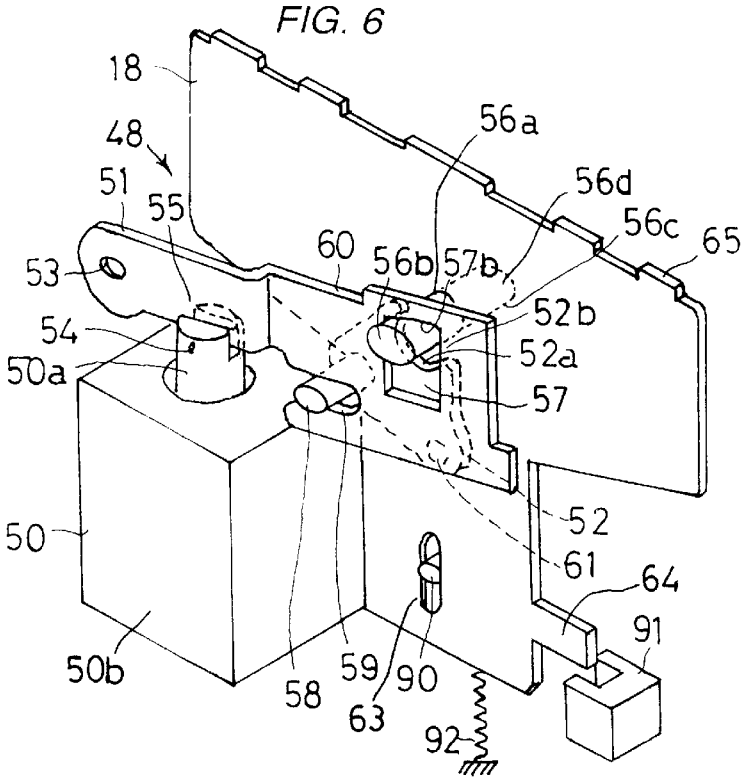
FIG. 6 is a perspective view of the shutter unit

As shown in FIG. 4, a bill validator 10 according to this invention comprises a validating unit 20 and a shutter unit 17 attached to a front side of the validating unit 20. FIG. 5 indicates the shutter unit 17 including a through hole 74 which has an inlet 72 provided at one end of the through hole 74 to insert a bill into the through hole 74, and an outlet 75 provided at the other end of the through hole 74 to discharge the bill. The shutter unit 17 comprises a shutter frame 70 for covering the link 51 and a control unit 48 including a clasp 52; and a bolt 71 which removably secures the shutter frame 70 to the case 11 of the validating unit 20. Mounted in the vicinity of the inlet 72 of the shutter unit 17 is an inlet sensor 73 (FIG. 5) which produces a detection signal when a bill is inserted into the inlet 72.

Figure 7:
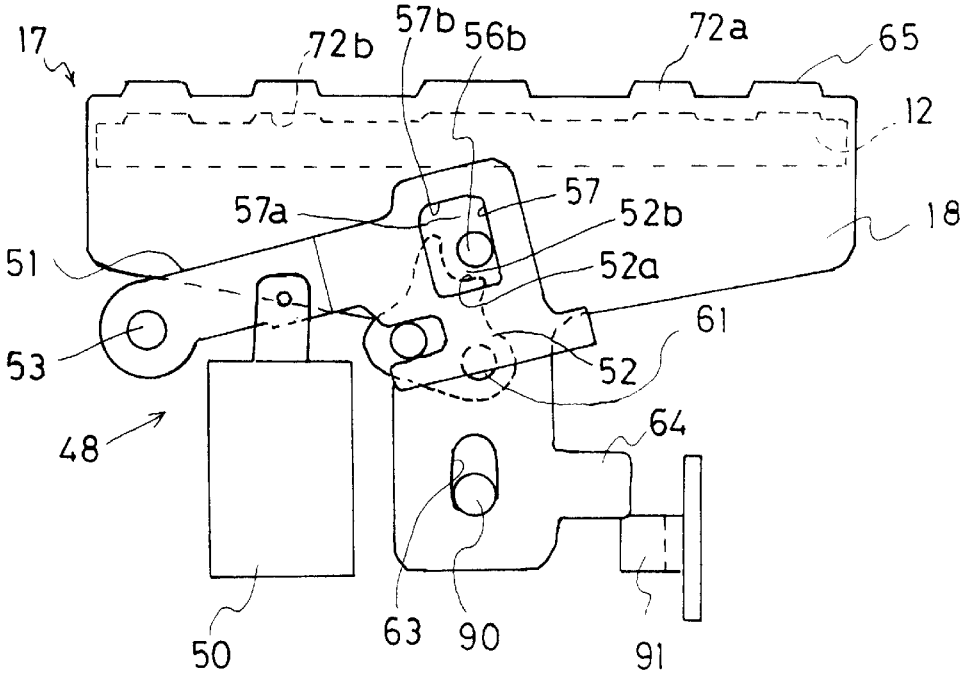
FIG. 7 is a front view of the shutter unit having a blocking member in an interceptive position.
Figure 8:
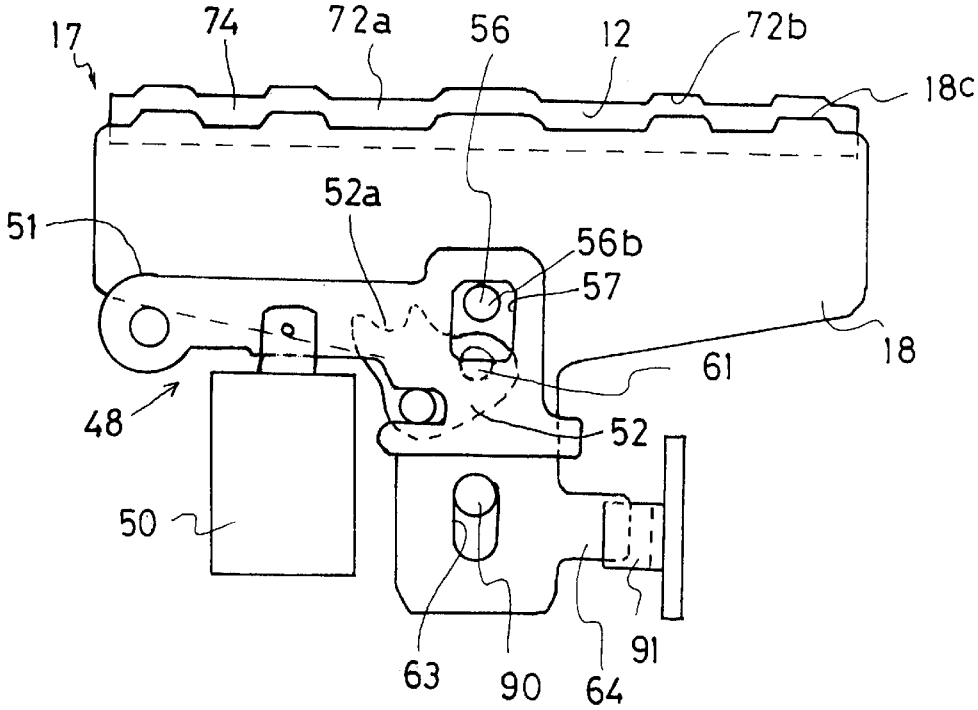
FIG. 8 is a front view of the shutter unit with the blocking member in a release position.

As understood from FIG. 4, the validating unit 20 comprises a case 11, a passageway 12 formed in the case 11 to pass a bill therethrough and having a slot 13 and an outlet 14 at the opposite ends thereof, a conveying device 15 for transporting the bill from the slot 13 through the passageway 12 to the outlet 14; and bill sensors 16 disposed adjacent to the passageway 12 for detecting an optical or magnetic feature of the bill. A slot sensor 40 mounted in the vicinity of the slot 13 produces a detection signal when the bill is inserted into the slot 13. The shutter unit 17 also comprises a blocking member 18 movable between an interceptive position shown by dotted line in FIG. 5 and by FIG. 7 for closing the through hole 74 of the shutter unit 17 and a release position shown by solid line in FIG. 5 and FIG. 8 away from the through hole 74 for allowing passage of the bill through the through hole 74 into a slot 13 of the validating unit 20. As shown in FIG. 8, provided in the shutter unit 17 is a control unit 48 which includes a link 51 drivingly connected with an actuator 50; and a clasp 52 rotatable around a shaft 61 between the inactive and operative positions shown in FIGS. 7 and 8 upon operation of the actuator 50 to prevent and allow movement of the blocking member 18 to the release position when the clasp 52 is moved respectively to the inactive position shown in FIG. 7 and the operative position shown in FIG. 8. The blocking member 18 is resiliently urged by a spring 92 toward the interceptive position.

The link 51 is rotatably mounted by a shaft 53 on a shutter frame 70 and drivingly connected at a pivotal portion 55 by a pin 54 with a movable plunger 50*b* provided in the actuator 50 which includes a solenoid 50*a* and a return spring (not shown) to resiliently push the link 51 to the upper position when the solenoid 50*a* is deenergized. Accordingly, activation of the solenoid 50*a* causes rotation of the link 51 around the shaft 53 in the clockwise direction to move the control unit 48 to the operative position. The return spring provided in the solenoid 50*a* serves to rotate the link 51 in the counterclockwise direction when the solenoid 50*a* is deactivated, thus causing the control unit 48 to move to the inactive position. In this way, the actuator 50 can shift the control unit 48 between the inactive and operative positions. Otherwise, the actuator 50*b* may be of the bidirectional operation type without the return spring so that the validating control circuit 80 may produce an output to operate the solenoid 50*a* in the reverse direction in order to move the plunger 50*b* to the retracted position.

The clasp 52 of the control unit 48 is rotatably mounted on the shutter frame 70 around a shaft 61 between the inactive and operative positions upon operation of the actuator 50 to prevent and allow movement of the blocking member 18 to the release position. One end of an arm 58 is secured to the clasp 52 and the other end of the arm 58 passes through a notch 59 formed in the link 51 to drivingly connect the clasp 52 with the link 51 by a link mechanism. A protrusion 56 has an intermediate portion 56*a* secured to the blocking member 18, a front end 56*b* which passes through an opening 57 formed in the link 51, and a rear end 56*d* which extends from the rear surface of the blocking member 18 to form an abutment 56*c*. Accordingly, the link 51 is drivingly connected with the blocking member 18 with a gap 57*a* as shown in FIG. 7 to rotate the clasp 52 from the inactive to operative position of FIG. 8 by the link 51 before the blocking member 18 starts moving from the interceptive to release position. A vertical length of the opening 57 is larger than the diameter of the protrusion 56 as shown in FIG. 7 to form a gap 57*a* between the front end 56*b* of the protrusion 56 and an upper edge 57*b* of the opening 57.

The clasp 52 is formed with a blocking edge 52*a* spaced by a small gap 52*b* from the abutment 56*c* of the blocking member 18, however the blocking edge 52*a* can be in contact with the blocking member 18 if moved downwardly to bar movement of the blocking member 18 toward the release position when the control unit 48 is in the inactive position because the blocking edge 52*a* is vertically aligned at a dead point with the shaft 61 and the abutment 56*c* of the blocking member 18. In other words, if the blocking member 18 is moved downwardly when the clasp 52 is in the inactive position, the blocking edge 52*a* at the dead point receives the lowered abutment 56*c* of the protrusion 56 to prevent movement of the blocking member 18 toward the release position. In this case, the shaft 61 produces a resisting force against the vertical movement of the blocking member 18 when the abutment 56*c* is forcibly urged toward the blocking edge 52*a* of the clasp 52 at the dead point. A fixed stopper 90 is positioned in an elongated hole 63 formed in the blocking member 18 to determine a given vertical stroke of the blocking member 18 resiliently and upwardly urged by a spring 92. The blocking member 18 has a protrusion 64 which may pass through a photoelectric sensor 91 to produce electric signals upon vertical movement of the blocking member 18.

As shown in FIG. 4, a conveying device 15 comprises a pair of pulleys 21, 22; and a belt 23 wound around the pulleys 21, 22. The pulley 22 is operatively connected to a pull motor 38 to drive the belt 23 so that a bill is transported by the belt 23 from the slot 13 to the outlet 14. The pull motor 38 is provided with a rotary encoder 38*a* which calculates rotation of the pull motor 38 to detect the transported position and rate of the bill. The passageway 12 formed by the conveying device 15 is aligned with a carrier passage 26 formed in a transport apparatus 24 which comprises pulleys 27, 28, 29, 30 and 31 provided adjacent to the carrier passage 26, and a belt 32 wound around the transporting pulleys 27 to 31 so that the bill discharged from the outlet 14 of the bill validator 10 is continuously carried by the transport apparatus 24. The pulleys 27, 28 and 29 are rotatably mounted so that their upper surfaces are positioned nearly on a same plane toward push rollers 39, 33 and the pulley 31. A motor 34 has an output shaft to which a pinion 35 is mounted in engagement with an intermediate gear 36. An output gear 37 is meshed with the intermediate gear 36 for rotation together with a drive pulley 30 disposed outside an upwardly bent area 26*a* of the carrier passage 26 to smoothly drive the belt 32 along the bent area 26*a* of the carrier passage 26 to travel the bill through the bent area 26*a* and exit 26*b* into a stacker 25.

Figure 9:
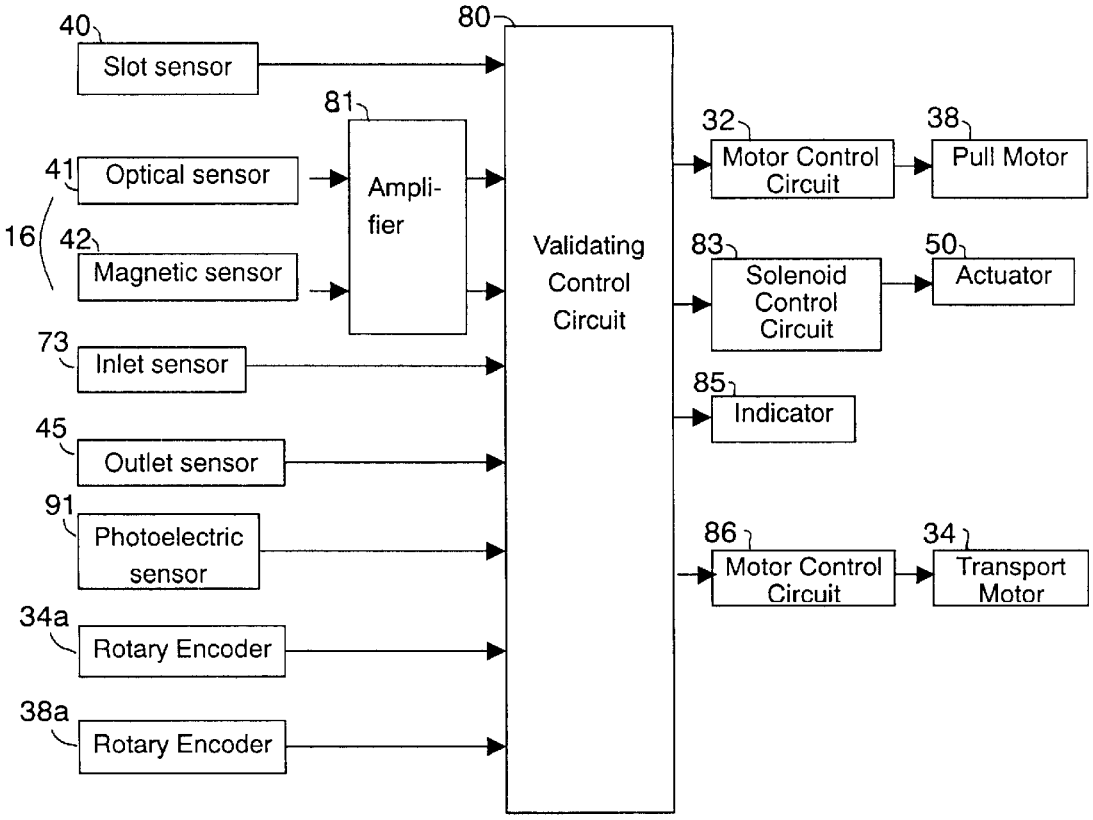
FIG. 9 is a block diagram of an electronic circuit used in the bill validator according to this invention.

As shown in FIG. 9, the actuator 50, inlet sensor 73 and slot sensor 40 are electrically connected with a validating control circuit 80 which activates the solenoid 50*a* of the actuator 50 when received the detection signal from the inlet sensor 73 to move the blocking member 18 to the release position. The validating control circuit 80 deactivates the solenoid 50*a* when received the detection signal from the slot sensor 40 to return the blocking member 18 to the interceptive position.

The validating control circuit 80 has its input terminals each connected with the slot sensor 40, inlet sensor 73, outlet sensor 45, photoelectric sensor 91 and rotary encoders 38*a* and 34*a*. The optical sensor 41 and magnetic sensor 42 are also connected with remaining input terminals of the validating control circuit 80 through an amplifier 81. Output terminals of the validating control circuit 80 are connected with a pull motor 38 via a motor control circuit 32, the actuator 50 via a solenoid control circuit 83, an indicator 85 and the transport motor 34 via a motor control circuit 86. Not shown but the validating control circuit 80 comprises a timer circuit formed therein by programmed control therein to decide whether a considerable first fixed time has elapsed after the inlet sensor 73 produces the output signal upon insertion of a bill into the inlet 72 until the bill is inserted through the slot sensor 40. The timer circuit is also utilized to decide whether a considerable second fixed time has elapsed after the outlet sensor 45 ceases the output signal upon completion of passage of the bill in order to confirm that the blocking member 18 is returned to the interceptive position by resilient force of the spring 92.

Figure 10:
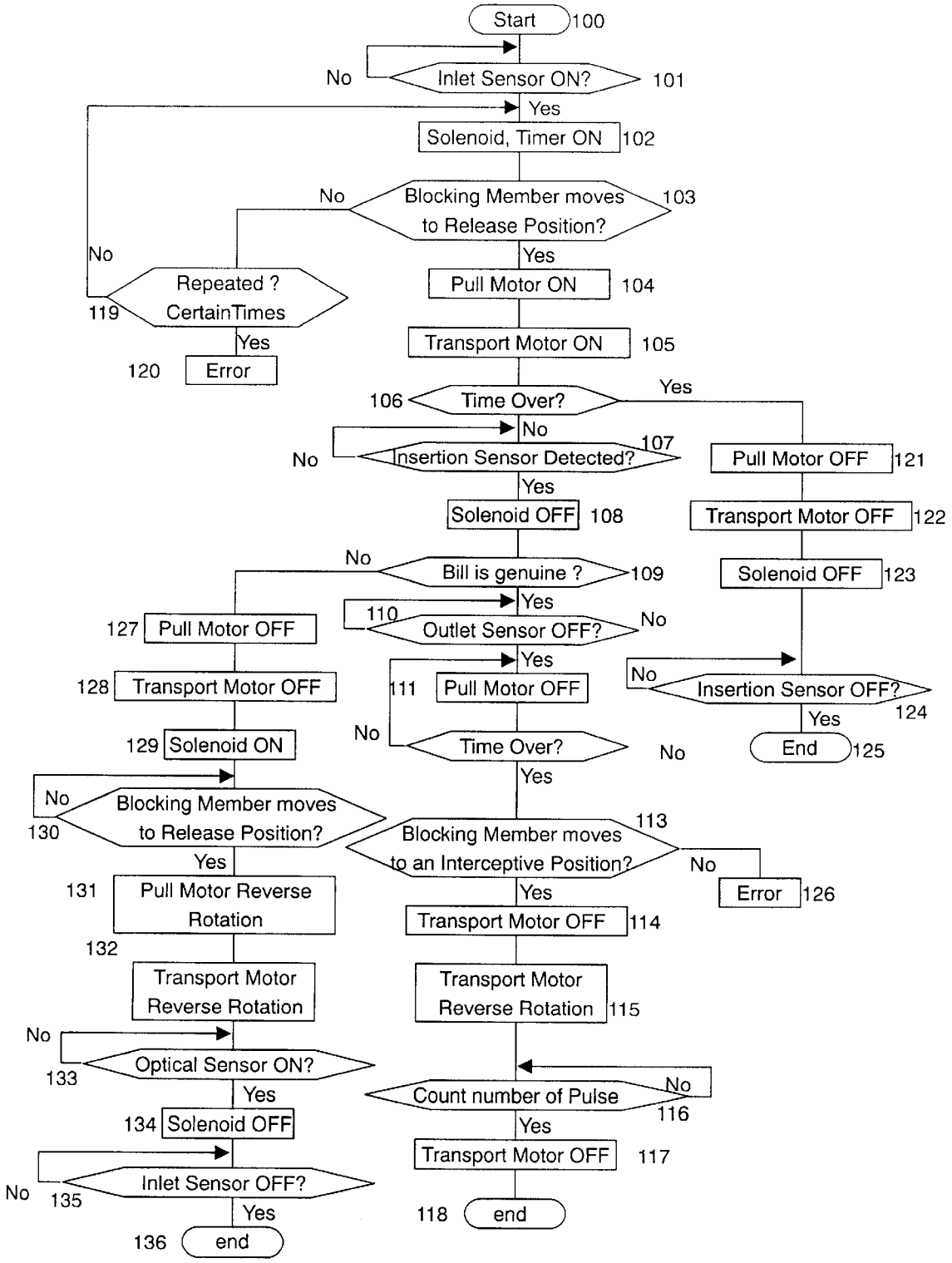
FIG. 10 is a flow chart showing an operational sequence of the bill validator.

The bill validator of the present invention is worked in accordance with an operational sequence shown in flow chart of FIG. 10.

When the processing moves from START in Step 100 to Step 101, the validating control circuit 80 decides whether the inlet sensor 73 produces an output by detecting a bill inserted into the inlet 72. If no bill is inserted into the inlet 72, the blocking member 18 is in the interceptive position as shown in FIGS. 4 and 7 and also indicated by dotted line in FIG. 5, and the blocking edge 52*a* is disposed in the upper position vertically aligned with the shaft 61 and abutment 56*c* of the protrusion 56. In this case, the blocking member 18 can forcibly be moved downward through the only small gap 52*b* by any tool in an unjust manner against the resilient force of the spring 92 until the abutment 56*c* is brought into contact with the blocking edge 52*a* at the dead point. However, after the abutment 56*c* comes into contact with the blocking edge 52*a*, the blocking member 18 can never be moved downwardly because the clasp 52 and shaft 61 firmly resist and prevent further downward movement of the blocking member 18 without application of any rotating force to the clasp 52 at the dead point. Accordingly, so far as the clasp 52 is not rotated from the inactive to the operative position to move the blocking edge 52*a* away from the dead point in vertical alignment with the shaft 61 and abutment 56*c*, it is impossible to move the blocking member 18 to the release position.

In this way, when the blocking member 18 is forcibly moved to the release position in an unauthorized manner, the control unit 48 in the inactive position effectively inhibits and resists movement of the blocking member 18 to the release position, thereby certainly preventing unauthorized extraction of the bill from inside of the bill validator by pulling out string or tape connected with the bill.

When a bill is inserted into the inlet 72 in Step 101, the inlet sensor 73 detects insertion of the bill and produces a detection signal to the validating control circuit 80 which forwards a drive signal to the actuator 50 through the solenoid control circuit 83, and at the same time, the validating control circuit 80 turns the timer circuit ON. By activation of the actuator 50, the solenoid 50*a* electromagnetically retracts the plunger 50*b* to rotate the link 51 around the shaft 53 in the clockwise direction. The rotation of the link 51 causes rotation of the shaft 58 and clasp 52 around the shaft 61 in the counterclockwise direction so that the blocking edge 52*a* is moved away from the dead point and free of the vertical alignment with the shaft 61. However, during the initial rotation of the link 51, the blocking member 18 is kept in the static condition due to the gap 57*a* until the upper edge 57*b* of the gap 57*a* comes into contact with the protrusion 56. After the blocking edge 52*a* is perfectly deviated from the vertical alignment with the shaft 61, the upper edge 57*b* of the opening 57 is brought into contact with the protrusion 56 and forcibly moves the blocking member 18 against the resilient force of the spring 92. Thus, the blocking member 18 is rotated from the interceptive position shown by FIG. 7 to the release position shown by FIG. 8 with subsequent rotation of the link 51. When the blocking member 18 reaches the release position, the photoelectric sensor 91 forwards an output to the validating control circuit 80. In Step 103, the validating control circuit 80 decides whether the blocking member 18 is in the release position, and when the validating control circuit 80 receives the output from the photoelectric sensor 91 as mentioned above, the processing moves to Step 104. In Step 103, if the validating control circuit 80 does not receive an output from the photoelectric sensor 91, it produces drive signals to the solenoid 50*a* several times in Step 119. If a given number of the drive signals is not repeatedly supplied to the solenoid 50*a*, the sequence is returned to Step 102. When the photoelectric sensor 91 does not generate its output to the validating control circuit 80 although it furnishes the solenoid 50*a* with the drive signals several times, the validating control circuit 80 generates an output representative of "ERROR" to the indicator 85 in Step 120.

In Steps 104 and 105, the validating control circuit 80 drives the pull motor 38 and transport motor 34 through the motor control circuits 82 and 86. Then, the validating control circuit 80 determines in Step 106 whether the timer circuit counts a predetermined period of time (a first fixed time) since it is turned ON in Step 102 to confirm that the slot sensor 40 detects existence of the bill in the predetermined period of time after passage of the bill through the inlet sensor 73. As the pull motor 38 is driven, the inserted bill is pulled into the validating unit 20 and transported by the conveying device 15 toward the outlet 14 during which the bill sensors 16 detect optical and magnetic features of the travelling bill, convert them into electric signals and forward these signals to the validating control circuit 80. In case the time is not over in Step 106, the validating control circuit 80 decides whether the slot sensor 40 detects the bill, and if this is "Yes", the circuit 80 ceases to produce the output to the solenoid 50*a* in Step 108. When the solenoid 50*a* is deactivated, the link 51 is returned from the operative to the inactive position by the return spring provided in the solenoid 50*a*. Accordingly, the blocking member 18 is returned to the upper interceptive position by virtue of the spring 92, and the clasp 52 is rotated in the adverse direction to the inactive position together with the arm 58 received in the notch 59 of the link 51. In the present invention, it is very important to return the blocking member 18 to the interceptive position before the whole bill passes through an upper end of the blocking member 18 in order to inhibit entry of cold air into the bill validator 10 and to thereby prevent breakdown of the bill validator 10 because of cold air. In addition, a plurality of longitudinal creases can be formed on surfaces of the bill by forcibly sandwiching the bill between a plurality of lugs 65 formed at the upper edge of the blocking member 18 and a plurality of dents 72*b* formed on an upper wall 72*a* of the passageway 12 to strengthen buckling resistance of the bill against bending force by the formed longitudinal creases and to thereby prevent jamming of the bill during transportation.

Subsequently, receiving the electric signals from the bill sensors 16, the validating control circuit 80 compares these signals with optical and magnetic patterns stored in a memory of the validating control circuit 80 and judges in step 109 whether the bill is genuine or not. If the signals supplied from the bill sensors 16 are corresponding to the stored optical and magnetic patterns, the validating control circuit 80 regards the bill as genuine, and the treatment goes to Step 110 wherein the validating control circuit 80 observes whether the outlet sensor 45 is turned OFF by thorough passage of the bill. Upon the switching action of the outlet sensor 45 to OFF, the circuit 80 ceases to supply the pull motor 38 with the drive signal, and therefore rotation of the pull motor 38 is stopped (Step 111). Then, in Step 112, the circuit 80 decides whether the timer circuit counts a predetermined time elapse (a second fixed time) after the switching action of the outlet sensor 45 to OFF. If the predetermined time is over, the circuit 80 judges in Step 113 whether the blocking member 18 is returned to the interceptive position in view of the output from the photoelectric sensor 91. If this is negative, the circuit 80 activates the indicator 85 to display "ERROR" in Step 126. Adversely, if receiving the output from the photoelectric sensor 91 indicative of the blocking member 18 being in the interceptive position, the circuit 80 ceases to generate the drive signal to the transport motor 34 which is therefore deactivated (Step 114).

Thereafter, the circuit 80 forwards a drive signal to the transport motor 38 to rotate it in the reverse direction so that a stacking mechanism (not shown) is operated to accumulate in the stacker 25 the bill carried from the transport apparatus 24 utilizing the drive power of the transport motor 38 in the reverse direction. To this end, the circuit 80 counts pulses generated in the rotary encoder 34*a*, and decides completion of the stacking operation of the bill when it counts up a predetermined number of the pulses from the rotary encoder 34*a* (Step 116). Next, the circuit 80 stops the operation of the transport motor 38 in Step 117, advancing to "END" in Step 118.

When the circuit 80 cannot decide in Step 109 that the bill is genuine, it ceases operation of the transport motor 38 in Step 127, and also operation of the pull motor 34 in Step 128. Successively, the circuit 80 provides the solenoid 50*a* with a drive signal to thereby activate it and move the blocking member 18 to the release position in order to return the bill to the inlet 72 (Step 129). When the blocking member 18 reaches the release position, the photoelectric sensor 91 gives rise to the electric signal to the circuit 80 which therefore can detect the blocking member 18 in the release position in Step 130. Following procedures are in Steps 131 and 132 where the transport motor 34 and pull motor 38 are driven in the adverse direction by outputs from the circuit 80 which then makes a decision whether the optical sensor 41 is switched to ON upon backward passage of the bill in Step 133. When a predetermined period of time has elapsed after the optical sensor 41 does not detect the bill, in other words when the bill is discharged from the belt 23 of the conveying device 15, the circuit 80 deenergizes the solenoid 50*a* and pull motor 38 in Step 134 so that the rear end of the returned bill comes out of the inlet 72. Specifically, the bill is kept on the way of the passageway 12 in the sandwiched condition between the lugs 65 formed at the upper edge of the blocking member 18 and the dents 72*b* formed on the upper wall 72*a* of the passageway 12. In this case, although the bill is sandwiched between the lugs 65 and the dents 72*b* by resilient force of the spring 92, an operator can manually grip the rear end of the bill, and easily pull same out of the shutter unit 17 to remove the bill. After that, as the circuit 80 makes a judgment that the bill is pulled by the operator and is completely passed the inlet sensor 73 in Step 135, it ceases the operations of the transport motor 38 and pull motor 34, then coming into Step 136.

Returning to Step 106, when the time is over, the circuit 80 stops operation of the transport motor 38 and pull motor 34 in Steps 121 and 122, and also ceases operation of the solenoid 50*a* in Step 123 so that the bill is retained with its rear end of the bill extending out of the inlet 72. In this case, although the bill is sandwiched between the lugs 65 and the dents 72*b* by resilient force of the spring 92, an operator can manually grip the rear end of the bill, and pull same out of the shutter unit 17. Subsequently, the circuit 80 decides whether the inlet sensor 73 is turned OFF by pulling the bill out of the shutter unit 17 by operator. If this is affirmative and the bill is completely passed the inlet sensor 73, the stage goes to Step 125.

While the shutter unit 17 comprises the shutter frame 70 which accommodates the solenoid 50*a*, link 51, clasp 52 and bolt 71, it is easy to attach and detach and exchange for repair the shutter unit 17 as an integrated assembly to the case 11 by tightening and loosing the bolt 71.

Figure 11:
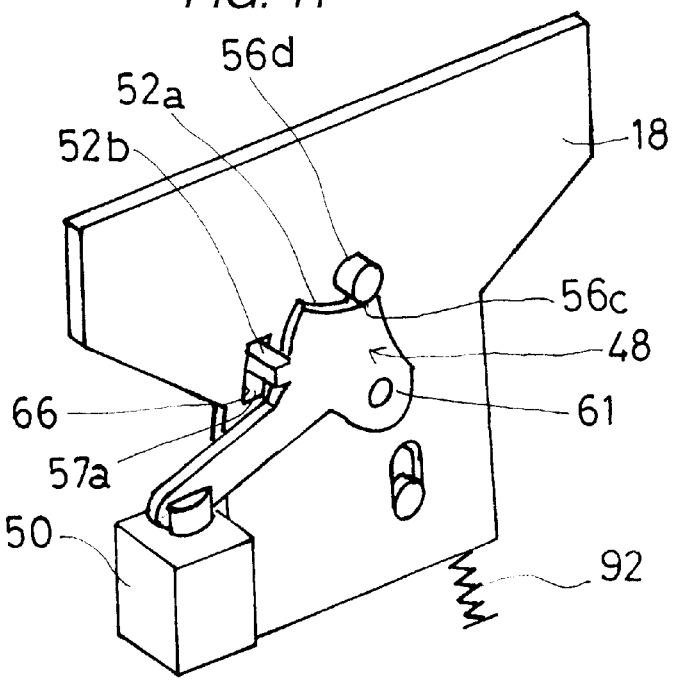
FIG. 11 is a perspective view of another embodiment form of this invention

The worked mode of the present invention may be varied. For example, as illustrated in FIG. 11, the clasp 52 may directly be operated by the actuator 50 without the link 51. In this embodiment, the blocking member 18 is in the interceptive position to prevent it from moving downwardly because the blocking edge 52*a* of the clasp 52 at the dead point in vertical alignment with the shaft 61 and abutment 56*c*. The clasp 52 is formed integrally with an arm 52*b* which extends through a slit 66 formed in the blocking member 18 with a gap 57*a*. When the solenoid 50*a* is activated, the clasp 52 is rotated around the shaft 61, however, the blocking member 18 is retained in the static condition during the initial rotation of the clasp 52 due to existence of the gap 57*a*. Specifically, during the initial rotation of the clasp 52, the blocking edge 52*a* is moved away from the dead point. By further rotation of the clasp 52, the arm 52*b* is brought into contact with the lower edge of the slit 66 and forcibly moves the blocking member 18 downwardly toward the release position against the resilient force of the spring 92.

Alternatively, the blocking member 18 may have an arm which extends through an opening formed in the clasp 52 in lieu of the arm 52*b* as shown in FIG. 11 provided in the clasp 52 and positioned in the slit 66 of the blocking member 18.

Figure 12:
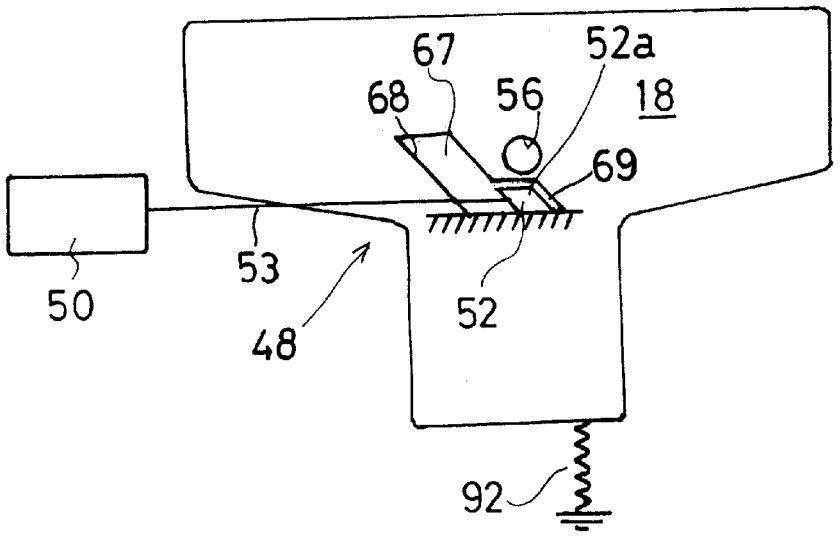
FIG. 12 is a front view of a still another embodiment of the present invention with a guide cam.

In still another embodiment of the instant invention shown in FIG. 12, the blocking member 18 may be formed with a guide cam 67 which comprises a slant cam 68 and a horizontal cam 69 connected with a lower end of the slant cam 68. A clasp 52 is positioned in the horizontal cam 69 to prevent downward movement of the blocking member 18 in the interceptive position. When the actuator 50 is activated, it retracts a plunger 53 to move leftward the clasp 52 which is brought into contact with the slant cam 68 to forcibly move downwardly the blocking member 18 toward the release position against resilient force of the spring 92. Adversely, when the actuator 50 extends the plunger 53, the blocking member 18 is returned to the interceptive position. In this way, the clasp 52 is effective to prevent downward movement of the blocking member 18 in the interceptive position. In addition, the opening 57 may be formed by a notch. The link 51 may be formed with a protrusion 56 which is received in an opening 57 formed in the blocking member 18.

In this way, the present invention can realize to firmly prevent unauthorized movement of the blocking member 18 from the interceptive to the release position. Accordingly, the present invention is very effective to inhibit unjust extraction of a bill from inside of the bill validator by pulling out string or tape connected with the bill. In addition, as the shutter unit can detachably be attached to the bill validator, it is very easy to exchange the shutter unit for repair, and also to attach the shutter unit to the bill validator as required.

What is claimed are:

1. A bill validator including a validating unit and a shutter unit attached to a front side of said validating unit, said shutter unit including a through hole formed with an inlet at one end of said through hole to insert a bill into said inlet, and an outlet at the other end of said through hole;

said shutter unit comprising a blocking member movable between an interceptive position for closing said through hole of the shutter unit and a release position away from said through hole for allowing passage of the bill through said through hole into a slot of said validating unit;

a control unit comprising a clasp movable between an inactive position for barring movement of said blocking member to the release position and an operative position for allowing movement of the blocking member to the release position; and an actuator for shifting said clasp between the inactive and operative positions.

2. The bill validator of claim 1, wherein said clasp is rotatably mounted on a shutter frame around a shaft between the inactive and operative positions upon operation of said actuator to prevent and allow movement of said blocking member to the release position.

3. The bill validator of claim 1, wherein said clasp is slidable along a guide recess between the inactive and operative positions by said actuator.

4. The bill validator of claim 1, wherein said control unit includes a link drivingly connected with said actuator;

said clasp is movably mounted on a shutter frame between the inactive and operative positions by the operation of said link.

5. The bill validator of claim 4, wherein said clasp is rotatable around a shaft between the inactive and operative positions upon operation of said actuator to prevent and allow movement of said blocking member to the release position when said clasp is moved respectively to the inactive position and the operative position.

6. The bill validator of claim 4, wherein said clasp is drivingly connected with said link which is also operatively connected with the blocking member with a gap to rotate said clasp from the inactive to operative position by said link before the blocking member starts moving from the interceptive to release position.

7. The bill validator of claim 5, wherein a protrusion is provided in one of said blocking member and link;

a notch is formed in the other of said blocking member and link to receive said protrusion with a gap.

8. The bill validator of claim 6, wherein a protrusion provided in said blocking member is positioned in said notch formed in said link with said gap.

9. The bill validator of claim 1, wherein said shutter unit comprises a shutter frame for covering said control unit which includes said clasp;

said validating unit comprises a case, a passageway formed in said case and having a slot and an outlet at the opposite ends thereof, a conveying device for transporting the bill from the slot through the passageway to the outlet; and a bill sensor disposed adjacent to the passageway for detecting an optical or magnetic feature of the bill, said shutter frame is detachably attached to said case.

10. The bill validator of claim 4, wherein said link is rotatably mounted by a shaft on a shutter frame and drivingly connected with said actuator.

11. The bill validator of claim 4, wherein said actuator comprises a solenoid with a plunger connected with said link.

12. The bill validator of claim 1, wherein said clasp is formed with a blocking edge in contact with said blocking member to bar movement of said blocking member toward the release position when said control unit is in the inactive position.

13. The bill validator of claim 12, wherein said clasp is formed with a blocking edge which can be vertically aligned with a shaft and an abutment of said blocking member so that said blocking edge is in contact with said abutment at a dead point to prevent movement of said clasp from the inactive to operative position, and thereby to bar movement of said blocking member toward the release position.

14. The bill validator of claim 1, wherein said actuator comprises a solenoid with a movable plunger connected with said control unit to move said clasp between the inactive and operative positions.

15. The bill validator of claim 13, wherein said shaft produces a resisting force against the vertical movement of said blocking member when said abutment of the blocking member is forcibly urged toward said blocking edge of the clasp at the dead point.

16. The bill validator of claim 1, wherein said shutter unit comprises a shutter frame for covering said clasp; and a bolt for removably attaching said shutter frame to a case of said validating unit.

17. The bill validator of claim 1, further comprising an inlet sensor mounted in the vicinity of the inlet of the shutter unit for producing a detection signal when a bill is inserted into the inlet; a slot sensor mounted in the vicinity of the slot for producing a detection signals when the bill is inserted into the slot; and a validating control circuit electrically connected with said actuator, inlet sensor and slot sensor, whereby upon receiving the detection signal from said inlet sensor, said validating control circuit activates said actuator to move said clasp from the inactive to operative position and move the blocking member from the interceptive to release position, and upon receiving the detection signal from said slot sensor, said validating control circuit deactivates said actuator to return the blocking member from the release position to the interceptive position and move said clasp from the operative to inactive position.

18. The bill validator of claim 1, wherein said blocking member is resiliently urged by a spring toward the interceptive position.

19. The validator of claim 1, wherein said blocking member is drivingly connected with said clasp with a gap.

20. The bill validator of claim 13, wherein a small gap is formed between said abutment and clasp to rotate said clasp while said blocking member is retained in the static condition.

* * * * *